US007618136B2

(12) United States Patent
Inoue et al.

(10) Patent No.: US 7,618,136 B2
(45) Date of Patent: Nov. 17, 2009

(54) INK TANK AND RECORDING APPARATUS USING INK TANK

(75) Inventors: Ryoji Inoue, Kawasaki (JP); Yasuo Kotaki, Yokohama (JP); Tetsuya Ohashi, Matsudo (JP); Shogo Kawamura, Numazu (JP); Hideki Ogura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 557 days.

(21) Appl. No.: 11/467,366

(22) Filed: Aug. 25, 2006

(65) Prior Publication Data

US 2007/0052771 A1 Mar. 8, 2007

(30) Foreign Application Priority Data

Sep. 2, 2005 (JP) ..... 2005-255197

(51) Int. Cl.
*B41J 2/175* (2006.01)

(52) U.S. Cl. ..... 347/86

(58) Field of Classification Search ..... 347/85, 347/86, 87

See application file for complete search history.

(56) References Cited

U.S. PATENT DOCUMENTS

| | | | | | |
|---|---|---|---|---|---|
| 3,876,282 | A | * | 4/1975 | Schon et al. | 399/238 |
| 4,664,815 | A | * | 5/1987 | Ozawa et al. | 210/96.1 |
| 5,918,093 | A | * | 6/1999 | Kim | 399/237 |
| 6,065,828 | A | * | 5/2000 | Lo et al. | 347/85 |
| 6,151,469 | A | * | 11/2000 | Lee | 399/237 |
| 6,341,209 | B1 | * | 1/2002 | Kim et al. | 399/237 |

FOREIGN PATENT DOCUMENTS

| | | | |
|---|---|---|---|
| JP | 2004-216761 | | 8/2004 |
| JP | 2005-066520 | | 3/2005 |
| JP | 2005-067094 | * | 3/2005 |

* cited by examiner

*Primary Examiner*—Anh T. N. Vo
(74) *Attorney, Agent, or Firm*—Canon USA Inc IP Div

(57) ABSTRACT

An ink tank includes a tank case and a stirrer. The proximal end of the stirrer is supported by the inner surface of the tank case in a pivotal manner. When the stirrer moves close to the inner surface of the ink tank, the stirrer is substantially parallel to the inner surface. The stirrer includes a through-hole in the vicinity of the proximal end thereof.

12 Claims, 11 Drawing Sheets

INK TANK AND RECORDING APPARATUS USING INK TANK

BACKGROUND OF THE INVENTION

1. Field of the Invention

The present invention relates to an ink tank and a recording apparatus using the ink tank.

2. Description of the Related Art

Examples of recording apparatuses using ink contained in an ink tank include inkjet recording apparatuses having an inkjet recording head capable of ejecting ink. Such inkjet recording apparatuses include a serial-scanning-type inkjet recording apparatus that records an image on a recording medium by moving a carriage including an inkjet recording head and an ink tank in a main scanning direction.

The serial-scanning-type inkjet recording apparatus includes a carriage having an inkjet recording head and an ink tank for supplying ink to the inkjet recording head. To perform recording, the inkjet recording apparatus moves the carriage relative to a recording medium and ejects ink droplets from a small ejection port. The ejected ink droplets are deposited on the recording medium so that a desired image is recorded.

Typically, dye ink has been used as ink for the inkjet recording head. The dye ink includes dye as a colorant. However, it is difficult to maintain the quality of dye ink for outdoor printed materials (such as resistance to light and resistance to climate). Therefore, instead of dye ink, pigment ink that includes a pigment as a colorant has been developed. However, since the pigment is not dissoluble, but dispersible, it is inevitable that pigment particles settle out inside an ink tank.

For example, if an ink tank is mounted in an inkjet recording apparatus and the inkjet recording apparatus is not operated for a long time, pigment particles in ink gradually settle out inside the ink tank. Accordingly, in the ink tank, a pigment dispersion graded in concentration from the bottom to the top of the tank occurs. As a result, the concentration of pigment particles in the lower portion of the ink tank is high so that an ink layer having too dark a color is formed. In contrast, in the upper portion of the ink tank, the concentration of pigment particles is low so that an ink layer having too light a color is formed.

When the ink in the ink tank is retrieved from the bottom of the tank and the retrieved ink is supplied to the recording head, the ink in the layer having high concentration of pigment particles is supplied first. Thus, an image having too dark color is recorded. That is, an easily recognizable difference may be created between the recording density of an image formed in an initial stage of use and that in a late stage of use. In particular, such a difference is noticeable in color recording for recording a color image using different densities of colors.

Japanese Patent Laid-Open No. 2004-216761 and Japanese Patent Laid-Open No. 2005-066520 describe a structure in which an ink tank includes a stirrer which is moved by means of an inertia force caused by the reciprocal movement of a carriage. Thus, ink is agitated in the ink tank.

That is, Japanese Patent Laid-Open No. 2004-216761 describes an ink tank including a freely swingable stirrer. The pivot of the swinging movement of the stirrer is determined to be positioned at substantially the center of the ink tank in the direction of the carriage movement. Thus, the stirrer moves similarly in one direction and the opposite direction by means of the reciprocal movement of the carriage. Additionally, Japanese Patent Laid-Open No. 2005-066520 describes an ink tank including a freely swingable stirrer that resiliently deforms. This stirrer hangs from substantially the center of the inner top surface of the ink tank. Thus, the stirrer also provides similar movements in one direction and the opposite direction by means of the reciprocal movement of the carriage. Furthermore, Japanese Patent Laid-Open No. 2005-066520 describes a structure in which an ink tank includes a stirrer that is freely movable on the bottom surface of the ink tank. Thus, the stirrer can freely move on the bottom surface of the ink tank in accordance with the reciprocal movement of the carriage.

However, the ink tanks described in Japanese Patent Laid-Open No. 2004-216761 and Japanese Patent Laid-Open No. 2005-066520 have the following disadvantages.

First, in the ink tank described in Japanese Patent Laid-Open No. 2004-216761, the stirrer swings about substantially the center of the ink tank similarly in one direction and the opposite direction. Accordingly, in order to increase the agitating performance by increasing the swing range of the stirrer, the width of the ink tank needs to be increased in the carriage movement direction. However, since, in most cases, a plurality of ink tanks are mounted in the carriage along the carriage movement direction, the width of the ink tank is limited to a relatively small value. Thus, the swing range of the stirrer cannot be increased. Therefore, the ink flow caused by the swing of the stirrer is weak. To sufficiently agitate the ink, the agitating time needs to be increased by increasing the number of reciprocal movements of the carriage.

In contrast, in the ink tank described in Japanese Patent Laid-Open No. 2005-066520, a stirrer hangs from substantially the center of the inner top surface of the ink tank and swings about substantially the center of the ink tank similarly in one direction and the opposite direction. To increase the agitating performance by increasing the swing range of the stirrer, the width of the ink tank needs to be increased in the carriage moving direction, like the ink tank described in Japanese Patent Laid-Open No. 2004-216761. Therefore, this structure has the same disadvantage as that of the ink tank described in Japanese Patent Laid-Open No. 2004-216761. Additionally, if the acceleration of the carriage is set to be high in order to cause large elastic deformation of the stirrer, the size and the manufacturing cost of a driving motor for driving the carriage increases. In addition, the vibration of the recording apparatus may increase. Furthermore, for the ink tank described in Japanese Patent Laid-Open No. 2005-066520 and having a stirrer freely movable on the bottom surface of the ink tank, since the stirrer is distant from the upper layer of ink in the ink tank, the performance of agitating the ink in the upper layer is not satisfactory.

Such disadvantages described in Japanese Patent Laid-Open No. 2004-216761 and Japanese Patent Laid-Open No. 2005-066520 are easily predictable from the following structure of widely used ink tanks and recording apparatuses.

In general, an ink tank mounted in a carriage (hereinafter also referred to as an "on-carriage-type ink tank") has a width and a length so that the operation of removing and attaching the ink tank from and to the carriage is easily carried out. That is, the width of the ink tank in the carriage moving direction is relatively small and the length of the ink tank in a moving direction of a recording medium (in the sub-scanning direction, which is perpendicular to the main scanning direction) is relatively large. Therefore, in the main scanning direction, which is a direction in which the stirrer is displaced, a large amount of displacement cannot be achieved. Since the amount of displacement of the stirrer is small, a strong ink flow cannot be generated. For this reason, the efficiency of agitating the ink is low and a long time is required for agitating the entire ink inside the ink tank. For example, when the recording apparatus with an ink tank mounted to the carriage is not operated for a long time and pigment particles of the ink in the ink tank settle out, reciprocal movements of the carriage is required for a long time before the recording operation starts. Thus, a long warm-up time is required before the recording operation becomes ready. In particular, when the diameter of the pigment particles of the pigment ink is large or a specific gravity of the pigment particles is large, the settlement is rapid. If the ink tank remains unused even for several days, the concentration distribution of ink that causes an adverse effect on the quality of a recording image may be generated. In this case, the ink must be agitated every few days. In addition, during the agitating operation, recording operation cannot be carried out.

SUMMARY OF THE INVENTION

The present invention is directed to an ink tank capable of efficiently agitating ink in an ink tank and a recording apparatus capable of recording a high quality image using ink of uniform thickness.

According to an aspect of the present invention, an ink tank includes a housing, an ink container disposed in the housing, and an ink supply port. The ink container is adapted to contain ink. The ink container includes a stirrer configured to agitate the ink and a supporting portion for supporting the stirrer. An inner wall of the housing defines an inner surface of the ink container. An ink supply port facilitates supplying the ink contained in the ink container to outside the ink tank. In the ink tank, the supporting portion is provided at least one of a position on the inner wall and a position in the vicinity of the inner wall so that the stirrer is capable of moving close to and apart from the inner wall, the stirrer has a supported end supported by the supporting portion and a moving end swingable about the supported end, and an area of a segment of the stirrer adjacent to the supported end is smaller than an area of a segment of the stirrer adjacent to the moving end.

According to another aspect of the present invention, a recording apparatus includes a mounting unit capable of mounting the above-described ink tank therein, where the recording apparatus records an image on a recording medium using ink supplied from the ink supply port of the ink tank mounted in the mounting unit, and a moving unit configured to swing the stirrer with an inertia force caused by reciprocally moving the ink tank mounted in the mounting unit.

According to the present invention, the proximal end of a stirrer is pivotally supported by the housing of an ink tank in the vicinity of the inner wall of the ink tank. When the stirrer moves close to the inner wall, the stirrer is substantially parallel to the inner wall. Consequently, a strong ink flow can be generated. Furthermore, a space is formed in the stirrer in the vicinity of the proximal end of a stirrer. Thus, a strong ink flow is generated in the vicinity of the proximal end of a stirrer, and therefore, the ink can be more efficiently agitated.

As a result, for example, before the recording operation is started or during the recording operation, by reciprocally moving the carriage including the ink tank, the ink in the ink tank can be efficiently agitated. In addition, even after the recording apparatus with the ink tank mounted therein remains unused for a long time, the ink can be sufficiently agitated simply by moving the carriage reciprocally in a short time before the recording operation is started. Accordingly, the recording operation can be started immediately after the recording apparatus is powered on. Furthermore, when pigment-based ink is contained in the ink tank, the concentration of the pigments can be uniform, and therefore, a high-quality image can be recorded.

Further features of the present invention will become apparent from the following description of exemplary embodiments with reference to the attached drawings.

DESCRIPTION OF THE EMBODIMENTS

Exemplary embodiments of the present invention are described with reference to the accompanying drawings.

First Exemplary Embodiment

Structure of Ink Tank

Figure 1:
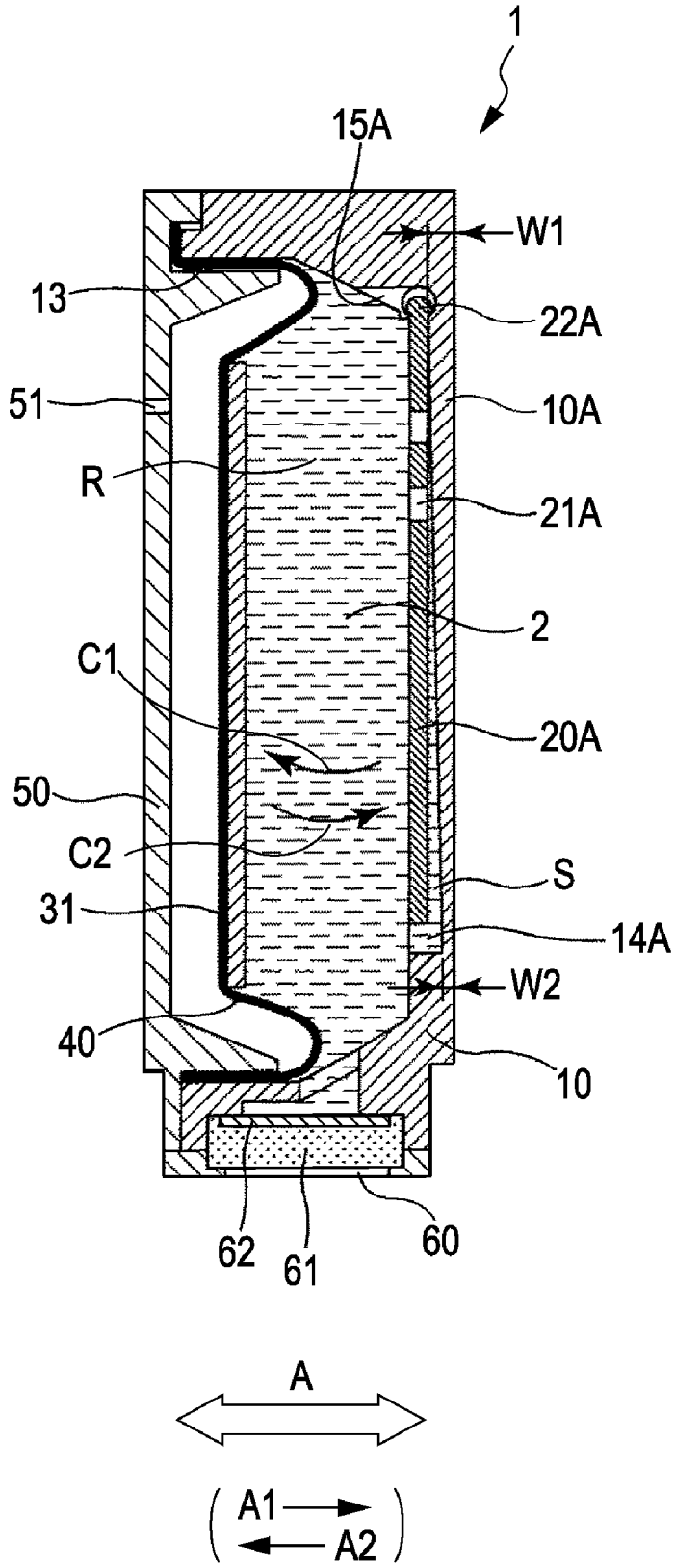
FIG. 1 is a cross-sectional view of an ink tank according to a first embodiment of the present invention.
Figure 2:
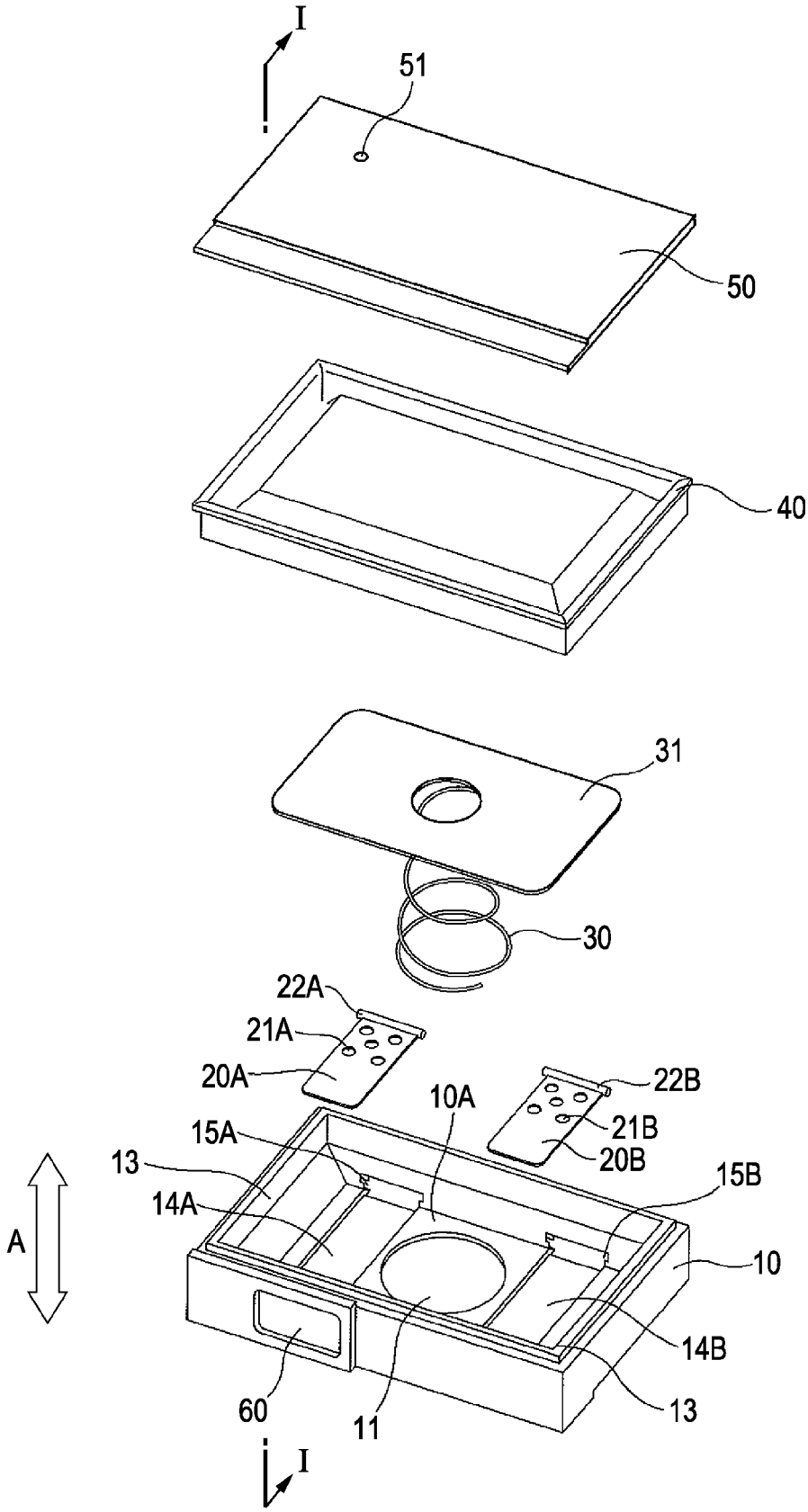
FIG. 2 is an exploded perspective view of the ink tank shown in FIG. 1.

FIG. 1 is a cross-sectional view of an ink tank 1 according to a first embodiment of the present invention. FIG. 2 is an exploded perspective view of the ink tank 1. FIG. 1 corresponds to a cross-sectional view taken along line I-I of FIG. 2.

The ink tank 1 is a container in which an ink container R formed from a tank case 10 and a flexible member 40 is filled with ink 2. As shown in FIG. 1, the ink tank 1 is mounted to an inkjet recording apparatus with an ink supply port 60 facing downward. The ink supply port 60 is connected to an ink supply channel of an inkjet recording head, which will be described below. According to the present embodiment, the ink tank 1 can be removed from the recording head. However, the ink tank 1 may be irremovably integrated into the recording head.

As shown in FIG. 2, the ink tank 1 includes the tank case 10, stirrers 20A and 20B, a spring 30, a pressing plate 31, the flexible member 40, and a cover 50. The tank case 10 and the cover 50 form a housing of the ink tank 1.

The stirrers 20A and 20B have a specific gravity higher than that of the ink 2 contained in the ink tank. The stirrers 20A and 20B have a weight and a rigidity so as to move in the ink 2 by means of an inertia force or a force externally applied to the ink tank.

The ink supply port 60 connectable to the inkjet recording head is formed on the tank case 10. As shown in FIG. 1, the ink supply port 60 includes a capillary tube 61 and a meniscus holder 62. The capillary tube 61 is formed from a material having a certain level of flexibility so that, when the recording head is connected to the ink supply port 60, the positional shift of the recording head in the vertical direction (the vertical direction in FIG. 1) can be absorbed. Additionally, the capillary tube 61 has a capillary force that generates a flow path of the ink 2. In the ink container R, a negative pressure is maintained so that the ink 2 does not drip off, as will be described below. The meniscus holder 62 generates meniscus of the ink so that a bubble is not drawn into the ink container R from the ink supply port 60 due to the negative pressure in the ink container R. Accordingly, a material that generates a meniscus holding pressure higher than the maximum negative pressure occurring in the ink container R is selected as the material of the meniscus holder 62.

The stirrers 20A and 20B located in the ink container R are attached to the tank case 10 so as to be swingable in directions shown by arrows C1 and C2. According to the first embodiment, the stirrer 20A includes a metal plate having a plurality of through-holes 21A and a pivot shaft 22A attached to the proximal end of the metal plate. Similarly, the stirrer 20B includes a metal plate having a plurality of through-holes 21B and a pivot shaft 22B attached to the proximal end of the metal plate. The plurality of through-holes 21A are formed at positions adjacent to the pivot shaft 22A (an upper portion of FIG. 1). Similarly, the plurality of through-holes 21B is formed at positions adjacent to the pivot shaft 22B (the upper portion of FIG. 1). At the positions shown in the right portion of FIG. 1 on an inner surface 10A of the tank case 10, supporting portions 15A and 15B for respectively supporting the pivot shafts 22A and 22B in a pivotal manner are formed. It should be noted that the supporting portions 15A and 15B may be formed at positions near the inner surface 10A within the scope of the present invention. Additionally, on the inner surface 10A of the tank case 10, concave recesses 14A and 14B are formed so as to face the stirrers 20A and 20B, respectively.

The through-holes 21A and 21B of the stirrers 20A and 20B form spaces to reduce the areas of the stirrers 20A and 20B facing the inner surface 10A. Since the stirrers 20A and 20B have a similar shape and a similar operation, only a description of the stirrer 20A is provided below.

Figure 3:
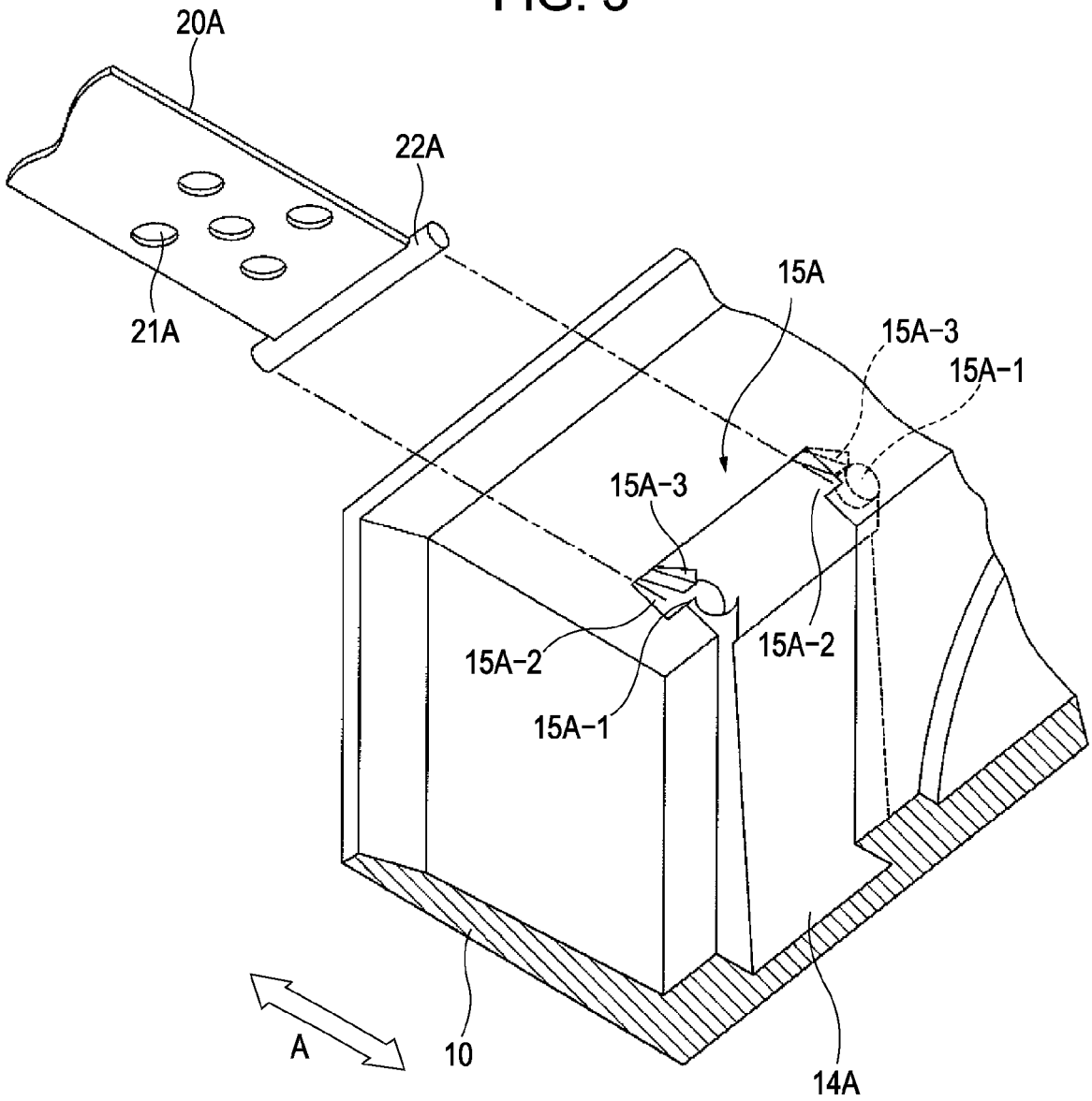
FIG. 3 is an enlarged perspective view of a supporting portion for supporting a stirrer in the ink tank shown in FIG. 1.

FIG. 3 is an enlarged perspective view of the supporting portion 15A and the vicinity thereof. In the supporting portion 15A, an undercut portion is formed that fits either end of the pivot shaft 22A of the stirrer 20A to pivotably support either end of the pivot shaft 22A. More specifically, the supporting portion 15A includes two holes 15A-1 that fit both ends of the pivot shaft 22A and two guide grooves 15A-2 that guide both ends of the pivot shaft 22A to the holes 15A-1. Additionally, the width of each of the two guide grooves 15A-2 is partially reduced by means of a wedge-shaped stopper 15A-3. When either ends of the pivot shaft 22A is strongly pushed into the guide groove 15A-2, the pivot shaft 22A and/or the supporting portion 15A temporarily and resiliently deform. Thus, either ends of the pivot shaft 22A fits into the hole 15A-1. As shown in FIG. 3, after either ends of the pivot shaft 22A has been inserted into the hole 15A-1, the stirrer 20A rotates.

After either ends of the pivot shaft 22A has been inserted into the hole 15A-1, the stirrer 20A does not come apart even when the ink tank 1 is distributed after the ink tank 1 is manufactured or the ink tank 1 is actually used. The inner diameter of the hole 15A-1 is slightly larger than the outer diameter of the end of the pivot shaft 22A. The stirrer 20A is supported by the holes 15A-1 so as to be pivotable about the pivot shaft 22A. In the first embodiment, as shown in FIG. 1, when the ink tank 1 is mounted with the ink supply port 60 facing downward, the proximal end of the stirrer 20A is supported so as to be pivotable about a substantially horizontal axis.

Figure 4:
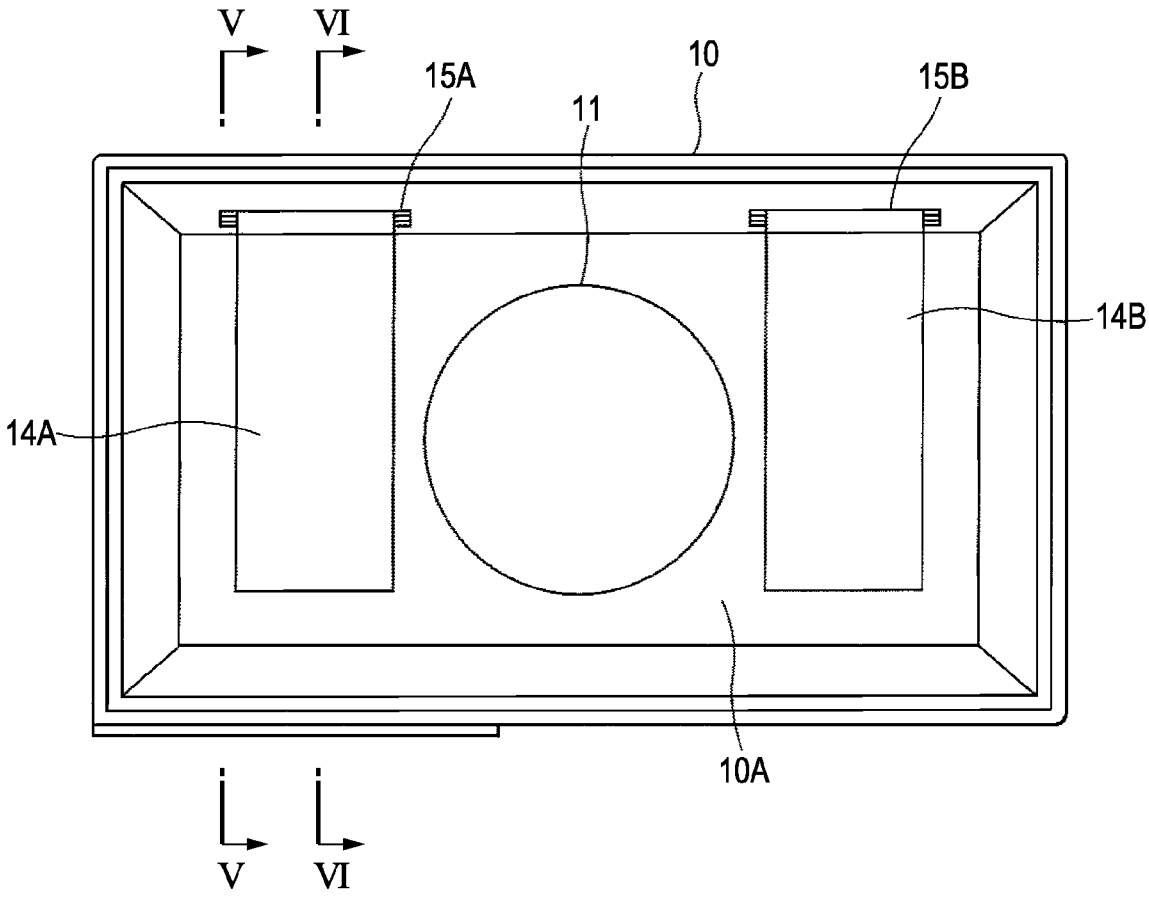
FIG. 4 is an enlarged view of a tank case of the ink tank shown in FIG. 1.
Figure 5:
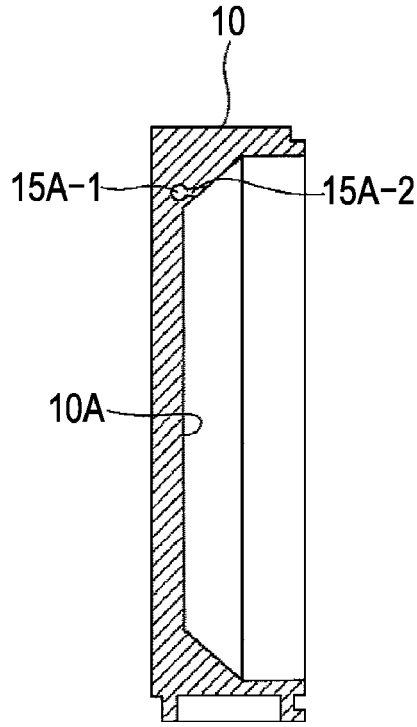
FIG. 5 is a cross-sectional view taken along line V-V of FIG. 4.
Figure 6:
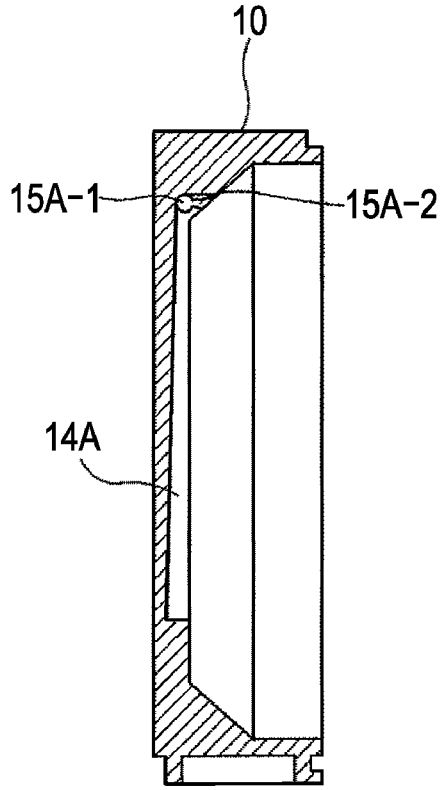
FIG. 6 is a cross-sectional view taken along line VI-VI of FIG. 4.

FIG. 4 is an enlarged view of the tank case 10. FIG. 5 is a cross-sectional view taken along line V-V of FIG. 4. FIG. 6 is a cross-sectional view taken along line VI-VI of FIG. 4.

According to the first embodiment, as shown in FIGS. 1 and 6, the recess 14A is formed by decreasing the thickness of the side portion of the tank case 10. This thickness gradually decreases from the pivot shaft 22A of the stirrer 20A towards the distal end of the stirrer 20A (the lower side of FIG. 1 or 6). That is, the thickness gradually decreases from the pivot shaft 22A of the stirrer 20A towards the distal end of the stirrer 20A, that is, from a value of W1 to a value of W2. In the first embodiment, for example, W1 is about 1.3 mm and W2 is about 1 mm. On the inner surface 10A of the tank case 10, the concave recess 14A to which the stirrer 20A fits is formed. As shown in FIG. 1, a space S is formed between the stirrer 20A and the inner surface 10A.

The spring 30A includes a conical coil spring. The spring 30 is disposed in an engraved portion 11 formed in the inner surface 10A. Additionally, the spring 30 is disposed so that the load center of the spring 30 substantially coincides with the center of gravity of the pressing plate 31. The periphery of the flexible member 40 is assembled to a weld zone 13 of the tank case 10 by means of heat welding. Thus, the flexible member 40 and the tank case 10 forms a closed space except for the ink supply port 60, namely, the ink container R.

According to the present embodiment, the shape of the central portion of the flexible member 40 is restricted by the pressing plate 31, which is a tabular supporting member. The periphery of the flexible member 40 is deformable. The central portion of the flexible member 40 is formed so as to be convexly curved in advance. The cross section of the flexible member 40 is substantially a trapezoid. As described below, the flexible member 40 deforms in accordance with the variation in the level of ink and the pressure in the ink container R. At that time, the peripheral portion of the flexible member 40 flexibly deforms in a balanced manner so that the central portion of the flexible member 40 horizontally moves while being parallel to the inner surface 10A of the tank case 10 (see FIG. 1). Since the flexible member 40 smoothly deforms (or moves), a shock due to the deformation does not occur, and therefore, an abnormal pressure change in the ink container R caused by the shock does not occur.

The spring 30, which can be a compression spring, urges the flexible member 40 towards the left direction in FIG. 1 via the pressing plate 31. Since the biasing force acts on the flexible member 40 so as to expand the ink container R, a predetermined negative pressure is generated in the ink container R. This negative pressure generates a holding force of a meniscus of ink formed in the ink ejection port and also applies a negative pressure that enables the recording head to eject the ink to the ink container R. That is, in the ink container R, the negative pressure that enables the recording head to eject the ink is generated. In FIG. 1, the ink container R is completely filled with ink. Even in this state, the spring 30 is compressed, and therefore, an appropriate pressure is generated in the ink container R.

The cover 50 is attached to the opening of the tank case 10. The cover 50 protects the flexible member 40. An atmosphere communication port 51 is provided to the cover 50 so that, in the tank case 10, atmospheric pressure is maintained outside the ink container R. The pressure in the ink container R is lower than the atmospheric pressure by a pressure determined by the pressing load of the spring 30 with respect to the pressing plate 31 and the area of the flat portion of the flexible member 40.

As shown in FIG. 1, the ink container R is completely filled with the ink 2. At that time, if the ink 2 is supplied to the recording head and is consumed, the pressing plate 31 moves to the right in FIG. 1 against the biasing force of the spring 30. Thus, the flexible member 40 deforms and the spring 30 is compressed. The negative pressure in the ink container R slightly increases by the increased load caused by the compression of the spring 30. As the consumption of the ink increases, the volume of the interior of the ink container R decreases. Finally, the pressing plate 31 is brought into contact with the bottom surface of the tank case 10, and therefore, the flexible member 40 cannot deform any more. The spring 30 can be a conical coil spring so that a wire ring of the spring 30 does not interfere with the other wire rings when the spring 30 is compressed. Thus, the spring 30 can be compressed until the height of the spring 30 becomes equal to the diameter of the wire. Since the entire spring 30 is accommodated in the engraved portion 11 when fully compressed, the spring 30 does not interfere with the deflection of the pressing plate 31.

When the pressing plate 31 is deflected in accordance with the consumption of the ink 2, the swing ranges of the stirrers 20A and 20B decrease. However, since the concave recesses 14A and 14B are formed in the tank case 10, the stirrers 20A and 20B can still swing. In addition, the deflection of the pressing plate 31 is not prevented by the stirrers 20A and 20B. Accordingly, the ink in the ink container R can be supplied and consumed until the pressing plate 31 is brought into contact with the inner surface 10A of the tank case 10.

Structure of Inkjet Recording Apparatus

Figure 7:
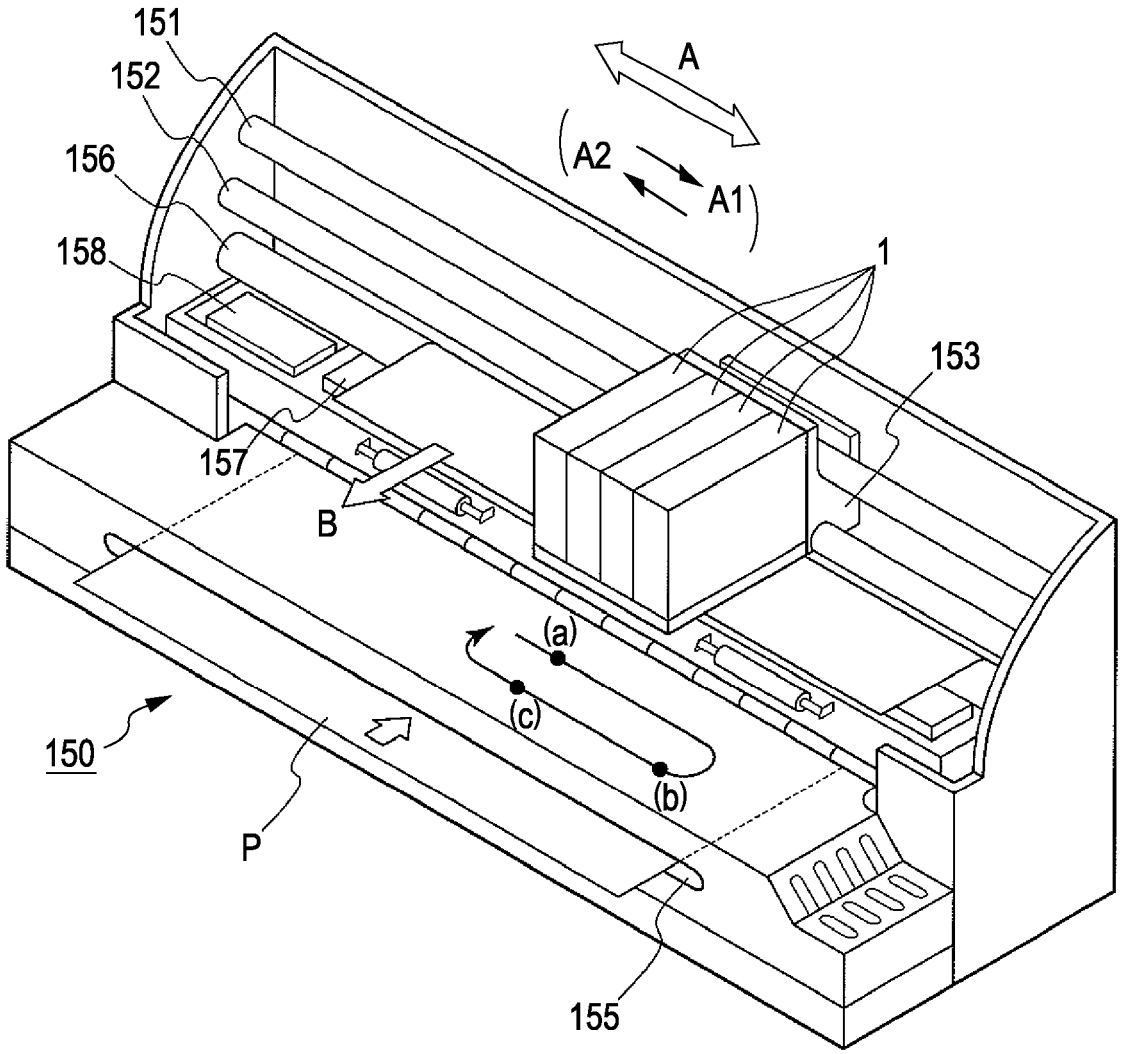
FIG. 7 is a perspective view of the main portion of an inkjet recording apparatus capable of including the ink tank according to the embodiment of the present invention.

FIG. 7 illustrates an exemplary structure of an inkjet recording apparatus according to an embodiment of the present invention.

A recording apparatus 150 according to the present embodiment is a serial-scanning-type inkjet recording apparatus. A carriage 153 is movable in a main scanning direction shown by arrow A while being guided by guide shafts 151 and 152. The carriage 153 reciprocally moves in the main scanning direction by means of a carriage motor and a driving transmission mechanism (e.g., a belt) for transmitting the driving force of the carriage motor. The carriage 153 can include an inkjet recording head (not shown) and the above-described ink tank 1 for supplying ink to the recording head. According to the present embodiment, four ink tanks 1 are mounted. However, the carriage 153 can include one or more ink tanks 1.

A paper sheet (recording medium) P is inserted into an insertion slot 155 provided to the front end of the recording apparatus 150. Thereafter, the moving direction of the inserted paper sheet P is reversed. The paper sheet P is then transported by a transport roller 156 in a sub-scanning direction shown by arrow B. By repeating a recording operation and a transport operation, the recording apparatus 150 sequentially records an image on the paper sheet P. In the recording operation, ink is ejected into a recording area of the paper sheet P placed on a platen 157 while the carriage 153 and the recording head are moved in the main scanning direction. As used herein, the term "transport operation" refers to an operation in which the paper sheet P is transported in the sub-scanning direction by a distance corresponding to the width of the recording area recorded in one scanning of the recording head.

Positions designated (a), (b), and (c) in FIG. 7 indicate positions on an imaginary trajectory of the carriage 153 when the carriage 153 reciprocally moves along the main scanning direction. The position (a) indicates the position of the carriage 153 when the carriage 153 is about to start in a forward direction indicated by arrow A1. The position (b) indicates the position of the carriage 153 when the moving direction of the carriage 153 is reversed and is about to start in a backward direction indicated by arrow A2. The position (c) indicates the position of the carriage 153 when the carriage 153 continuously moves in the direction indicated by arrow A2. By using such a reciprocal movement of the carriage 153 in the directions indicated by arrows A1 and A2, the ink 2 in the ink tank 1 is agitated, as is described below.

The recording head may utilize heat energy generated by an electrothermal transducer as energy for ejecting ink. In this case, the heat from the electrothermal transducer causes film boiling of the ink to generate bubble energy, which can eject the ink from an ink ejection port. However, the ink ejection method of the recording head is not limited to the method using such an electrothermal transducer. For example, a method of ejecting ink using a piezoelectric element may be applied.

As shown in FIG. 7, at the left end of the moving range of the carriage 153, a recovery unit (recovery processing unit) 158 is provided so as to face the formation surface of the ink ejection port of the recording head mounted on the carriage 153. The recovery unit 158 includes a cap for capping the ink ejection port of the recording head and a suction pump for introducing a negative pressure in the cap. By introducing a negative pressure in the cap that is covering the ink ejection port, ink is attracted and discharged from the ink ejection port. Thus, a recovery operation can be carried out so that a superior ink ejection performance of the recording head can be maintained. Additionally, by ejecting ink that does not contribute to the recording operation from the ink ejection head into the cap, a recovery operation can be carried out so that a superior ink ejection performance of the recording head can be maintained (this recovery operation is also referred to as a "preliminary ejection operation").

Agitation Mechanism

Figure 8A:
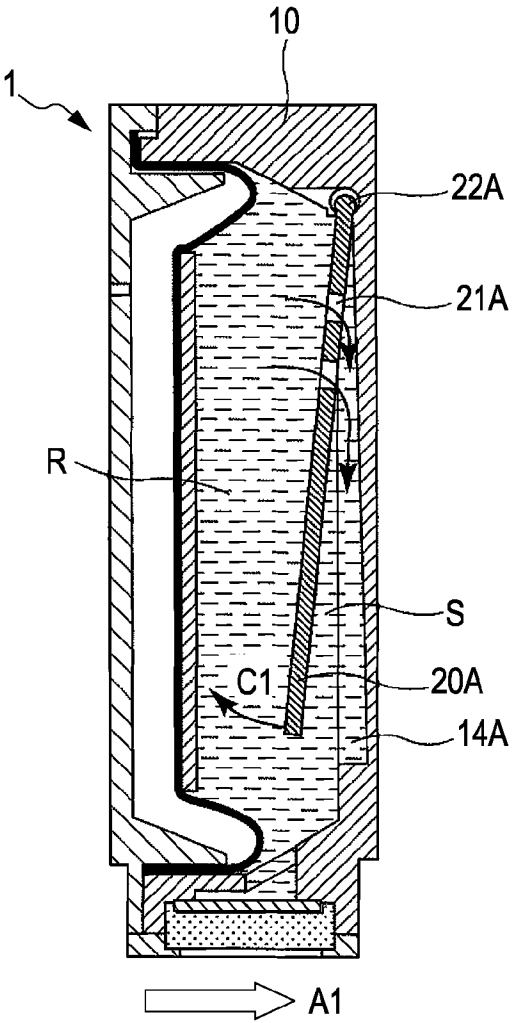
FIGS. 8A-C are cross-sectional views illustrating an agitation mechanism of the ink tank shown in FIG. 1.
Figure 8B:
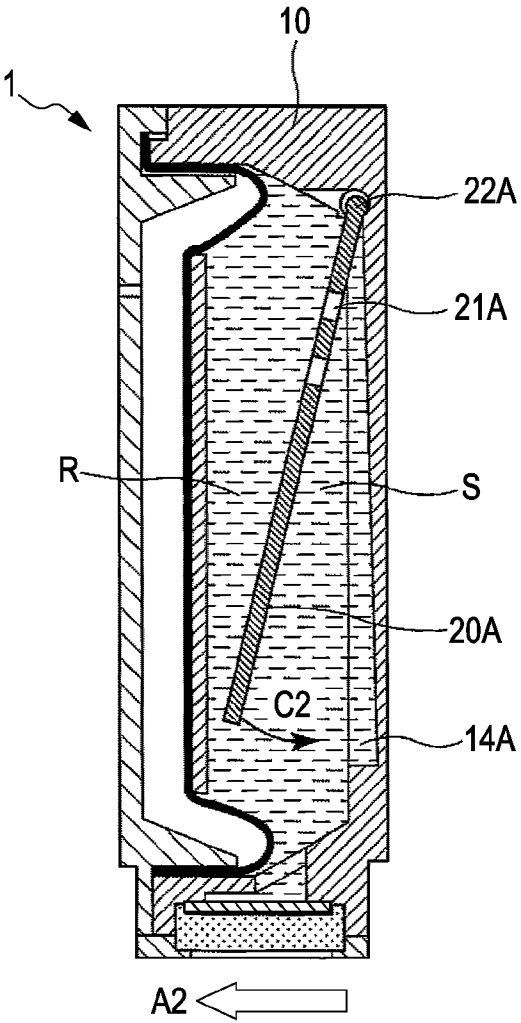
Figure 8C:
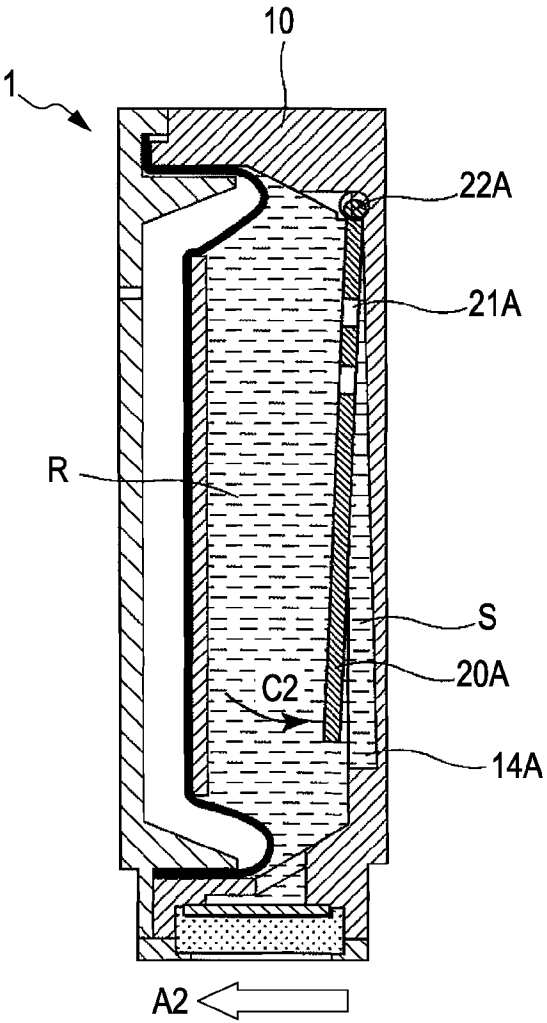

FIGS. 8A-C are cross-sectional views of the tank case 10 illustrating an operation performed by the stirrer 20A for agitating the ink 2. FIGS. 8A-C illustrate the agitating states at positions (a)-(c) of the carriage 153 shown in FIG. 7, respectively. The stirrer 20B operates in the same manner as the stirrer 20A.

As shown in FIG. 8A, when the carriage 153 is about to move in the direction shown by arrow A1, the stirrer 20A in the ink tank starts to swing in the direction shown by arrow C1 due to an inertia force. Since the stirrer 20A in the ink tank starts to swing in the direction shown by arrow C1, the space S formed between the stirrer 20A and the inner surface 10A expands. Thus, ink flows into the expanded space S. Most of the ink that flows into the space S passes along the peripheral portion of the stirrer 20A. In the space S in the vicinity of the central portion of the stirrer 20A, the flow resistance of the ink passing through the through-holes 21A is smaller than that of the ink passing along the peripheral portion of the stirrer 20A. Therefore, as shown by arrows in FIG. 8A, the ink passes through the through-holes 21A and flows towards the distal end (the lower end) of the stirrer 20A in the space S. The swing range of the stirrer 20A is smaller at the proximal end (the upper end) thereof than at the distal end (the lower end)

thereof. However, since the ink in the vicinity of the proximal end of the stirrer 20A is lead into the space S through the through-holes 21A when the stirrer 20A is separated from the inner surface 10A, even the ink in the vicinity of the proximal end of the stirrer 20A can be efficiently agitated.

As shown in FIG. 8B, when the movement of the carriage 153 is reversed and the carriage 153 is about to move in the direction shown by arrow A2, the stirrer 20A which has swung to the maximum in the direction shown by arrow C1 is about to swing in the direction shown by arrow C2 due to the deceleration and the acceleration of the carriage 153 in the direction shown by arrow A2. Thus, the distance between the stirrer 20A and the inner surface 10A starts to decrease, and therefore, the ink starts to flow in a direction opposite to that shown in FIG. 8A. In the state shown in FIG. 8B, since the distance between the stirrer 20A and the inner surface 10A is large, the ink slowly flows and the flow resistance is significantly small.

Figure 9:
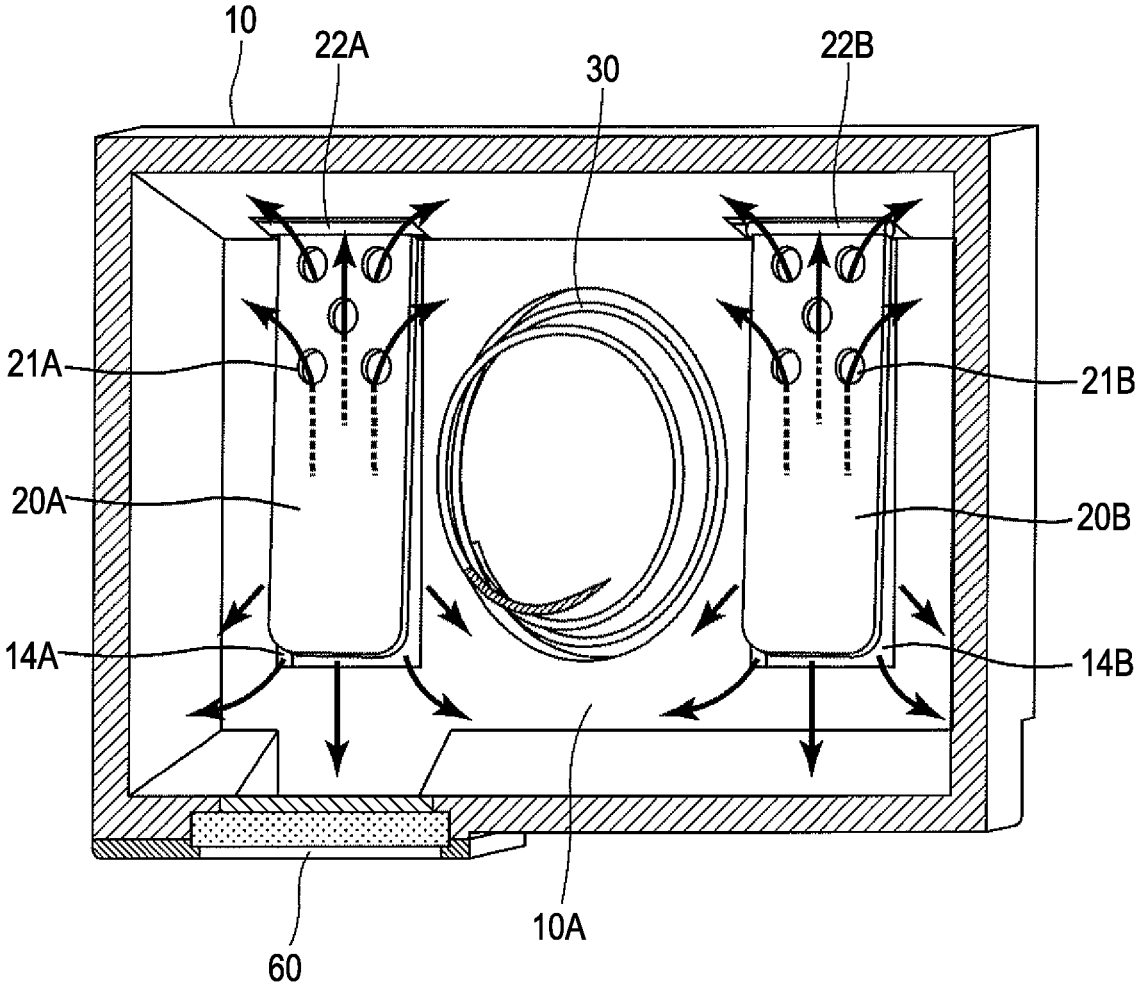
FIG. 9 is a diagram illustrating an ink flow in the ink tank shown in FIG. 1 in the state shown in FIG. 8C.

Subsequently, as shown in FIG. 8C, when the carriage 153 continuously moves in the direction shown by arrow A2, the stirrer 20A moves closer to the inner surface 10A. The ink in the space S is expelled along the peripheral portion of the stirrer 20A and through the through-holes 21A. When the stirrer 20A is brought into near contact with the tank case 10, the surface of the stirrer 20A is substantially parallel to the inner surface 10A. Thus, the ink is strongly expelled. At that time, if the flow resistance of the ink expelled from the space S is greater than the inertia force acting on the stirrer 20A, the swing speed of the stirrer 20A significantly decreases. Therefore, the inertia force acting on the stirrer 20A can be determined to be greater than the flow resistance of the ink by adjusting the accelerating force of the carriage 153, the mass of the stirrer 20A, or the size of the through-hole 21A. By sufficiently increasing the inertia force acting on the stirrer 20A, a strong ink flow is generated, as shown in FIG. 9, when the stirrer 20A is brought into near contact with the concave recess 14A. That is, a strong ink flow is generated in the vicinity of the peripheral portion of the lower end of the stirrer 20A and in the vicinity of the through-holes 21A.

Such an ink flow can increase the agitation efficiency of the entire ink in the ink container R. In particular, since the ink in the space S flows upwardly through the through-holes 21A, even the ink in the upper portion of the ink container R can be efficiently agitated. That is, when the stirrer 20A is brought into near contact with the inner surface 10A and a strong ink flow is generated, that ink flow is partially lead to the vicinity of the proximal end of the stirrer 20A. Thus, even the ink in the vicinity of the proximal end of the stirrer 20A can be efficiently agitated.

Thereafter, the state of the stirrer 20A shown in FIG. 8C returns to the state shown in FIG. 8A. Subsequently, the state repeatedly changes from the state shown in FIG. 8A, to the state shown in FIG. 8B, and to the state shown in FIG. 8C until the reciprocal movement of the carriage 153 stops.

If the ink tank 1 is mounted in the carriage 153 and the recording apparatus is not operated for a long time, pigment particles of ink in the ink tank 1 settle out inside the ink tank 1, and the concentration distribution that causes the ink density to vertically vary in the ink tank 1 is generated. In such a case, the above-described ink flow in the vertical direction can efficiently agitate the ink. Accordingly, the ink in the ink container R can be reliably agitated in a short time so as to obtain uniform ink density.

According to the present embodiment, in order to generate a strong ink flow, the supporting portions 15A and 15B of the stirrers 20A and 20B are formed on the inner surface 10A or in the vicinity of the inner surface 10A of the tank case 10, as described above. Furthermore, when the stirrers 20A and 20B move close to the inner surface 10A, the inner surface 10A (the bottom surfaces of the concave recesses 14A and 14B in this embodiment) is substantially parallel to the side surfaces of the stirrers 20A and 20B (the surfaces on the right in FIG. 1) that face the inner surface 10A. Still furthermore, to increase the efficiency of agitating the ink in the vicinities of the proximal ends of the stirrers 20A and 20B, the through-holes 21A and 21B are formed in the stirrers 20A and 20B in the vicinities of the proximal ends of the stirrers 20A and 20B.

It is noted that, if the supporting portion of the stirrer is provided to substantially the central position of the inner top surface of the tank case 10 and the supporting portion is distant from the inner side surface of the tank case 10, only the lower end of the stirrer moves close to the inner surface 10A of the tank case 10. Accordingly, the stirrer is not substantially parallel to the inner surface 10A. Consequently, a strong ink flow cannot be generated. In particular, in the vicinity of the proximal end of the stirrer, the ink flow is weak, and therefore, the efficiency of agitating the ink becomes significantly low. As a result, in order to sufficiently agitate the ink, a long time is required.

Since the pressing plate 31 moves closer to the inner side surface of the tank case 10 as ink in the ink container R is consumed, the allowed swing range of each of the stirrers 20A and 20B gradually decreases. However, according to the first embodiment, the concave recesses 14A and 14B are formed on the side of the tank case 10, where the ink in the ink container R remains until consumed. Thus, the agitation functionality of the stirrers 20A and 20B can be maintained until the last drop of ink is consumed. Additionally, since the concave recesses 14A and 14B are formed, the width of the ink tank 1 in the horizontal direction in FIG. 1 can be set to be small while ensuring the allowed swing ranges of the stirrers 20A and 20B. As a result, a plurality of ink tanks 1 can be compactly arranged on the carriage 153 in the main scanning direction indicated by arrow A.

Second Exemplary Embodiment

Figure 10:
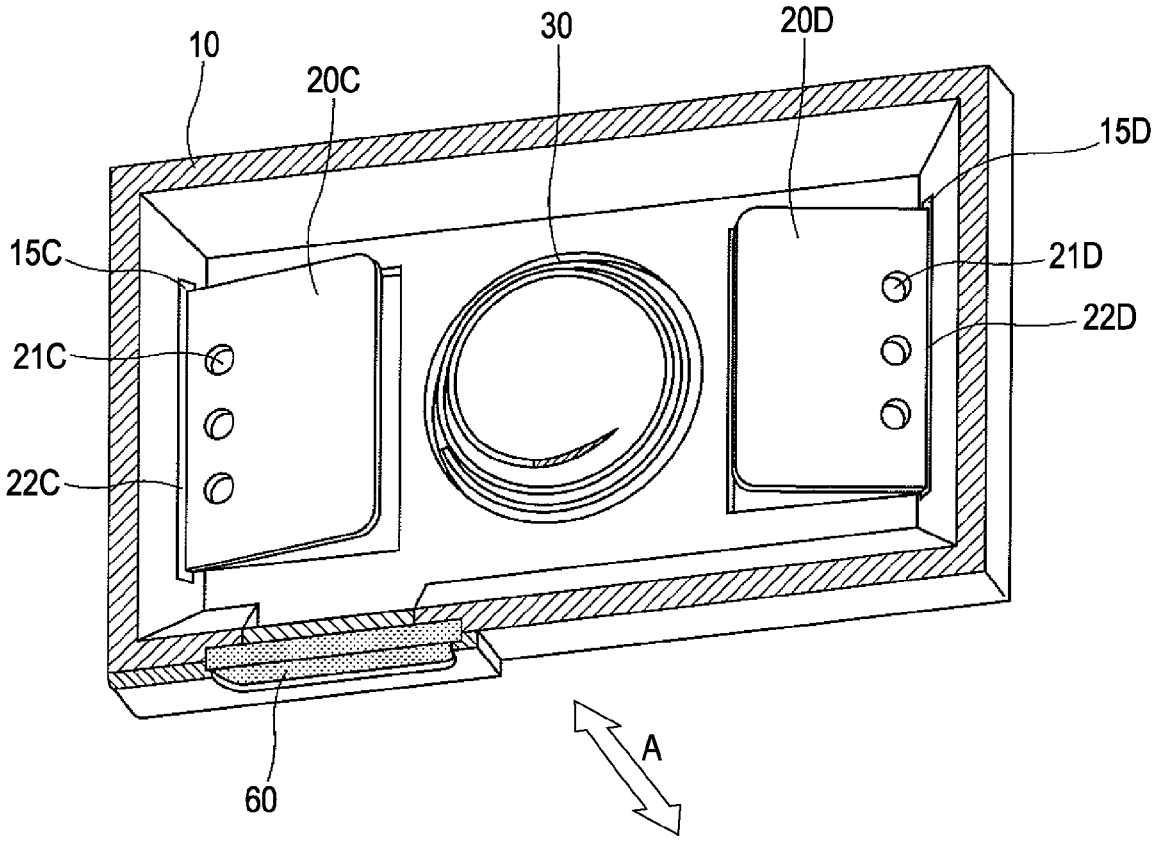
FIG. 10 is a perspective view of the main portion of an ink tank according to a second embodiment of the present invention.

FIG. 10 is a cross-sectional view of an ink tank according to a second embodiment of the present invention.

According to the second embodiment, when, as shown in FIG. 10, the ink tank is disposed with an ink supply port 60 facing downwards, pivot shafts 22C and 22D of stirrers 20C and 20D are supported by supporting portions 15C and 15D so as to be swingable about a substantially vertical axis. Basically, the supporting portions 15C and 15D and the pivot shafts 22C and 22D are similar to the above-described supporting portions 15A and 15B and pivot shafts 22A and 22B, respectively. However, mounting positions thereof are different. A plurality of through-holes 21C and 21D are formed in the stirrers 20C and 20D at positions adjacent to the pivot shafts 22C and 22D, respectively. Like the first embodiment, the ink tank reciprocally moves in a main scanning direction indicated by arrow A together with a carriage 153. Thus, the inertia force causes stirrers 20C and 20D to swing so that ink in the ink tank is efficiently agitated. Additionally, since an ink flow is generated in the vicinities of the proximal ends of the stirrers 20C and 20D through the through-holes 21C and 21D, the entire ink in the ink container R is efficiently agitated. Furthermore, since the two stirrers 20C and 20D synchronously swing, the ink flow generated by the swinging stirrers 20C and 20D is merged in the vicinity of a spring 30 so as to generate a turbulent flow. This turbulent flow of the ink more efficiently agitates the ink.

Third Exemplary Embodiment

Figure 11:
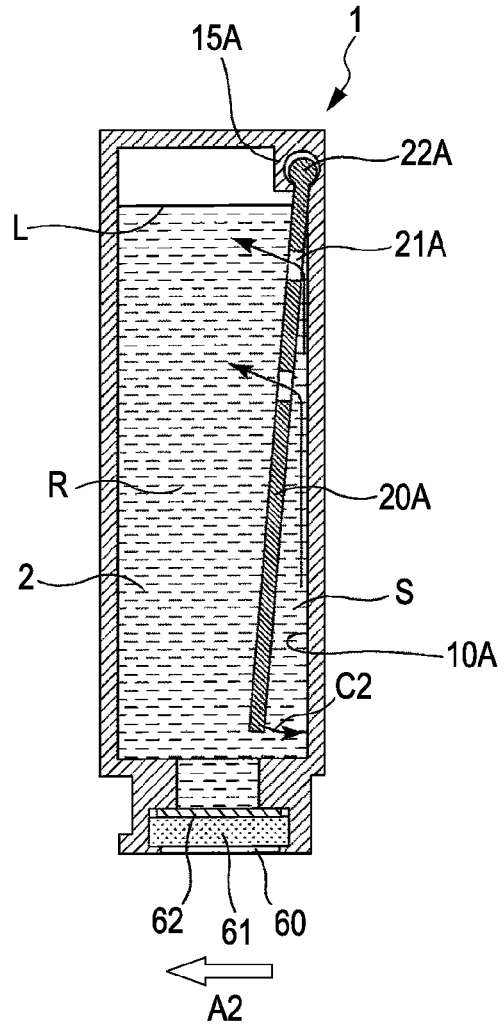
FIG. 11 is a cross-sectional view of an ink tank according to a third embodiment of the present invention.

FIG. 11 is a cross-sectional view of an ink tank 1 according to a third embodiment of the present invention.

In the above-described embodiments, the ink tank 1 has a structure in which a predetermined negative pressure is maintained in the ink container R using a negative pressure control mechanism including the flexible member 40 and the spring 30. According to the third embodiment, the ink tank 1 includes an outside-air intake mechanism for controlling the pressure in the ink container R to be a predetermined negative pressure. The outside-air intake mechanism draws the outside air into the ink container R so as to maintain the pressure in the ink container R to be a predetermined negative pressure with respect to the atmosphere. For example, the outside-air intake mechanism may have a structure in which a small gap is provided to the bottom surface of the ink tank 1 and the meniscus formed by the ink in the gap causes the pressure in the ink container R to be negative with respect to the atmosphere. As described above, by drawing the outside air into the ink container R, the entire ink supply in the ink container R can be used up.

In the ink tank 1 according to the present embodiment, since the outside air is drawn into the ink container R, the liquid level L of the ink 2 varies. In FIG. 11, the ink container R is sufficiently filled with the ink 2, and therefore, the liquid level L of the ink 2 remains at a relatively high position. As the remaining amount of ink decreases with the consumption of the ink 2, the liquid level L is lowered. When the remaining amount of ink becomes small and the percentage of the air in the ink container R increases, no ink is present in the vicinity of the proximal end of the stirrer 20A and the ink is agitated only in the vicinity of the distal end of the stirrer 20A. In addition, since the liquid level L varies in accordance with the reciprocal movement of the ink tank 1, an ink flow can be generated in the vicinity of the liquid level L. Thus, the entire ink 2 can be efficiently agitated.

As shown in FIG. 11, when the ink container R is sufficiently filled with the ink 2 and the amount of air in the ink container R is small, the efficiency of agitating the ink 2 tends to decrease. However, even in this case, the stirrer 20A can efficiently agitate the ink 2. That is, like the above-described embodiments, by supporting the stirrer 20A in the vicinity of the inner surface 10A and providing the through-holes 21A to the stirrer 20A in the vicinity of the proximal end thereof, the efficiency of agitating the ink 2 can be increased. However, when the liquid level L is positioned at a level lower than the through-holes 21A in accordance with the consumption of the ink 2, the effect of the through-holes 21A disappears.

Additionally, like the first embodiment, a stirrer 20B having the same structure as that of the stirrer 20A may be provided. Furthermore, like the second embodiment, stirrers 20C and 20D that swing about a substantially vertical axis may be provided.

Fourth Exemplary Embodiment

Figure 12:
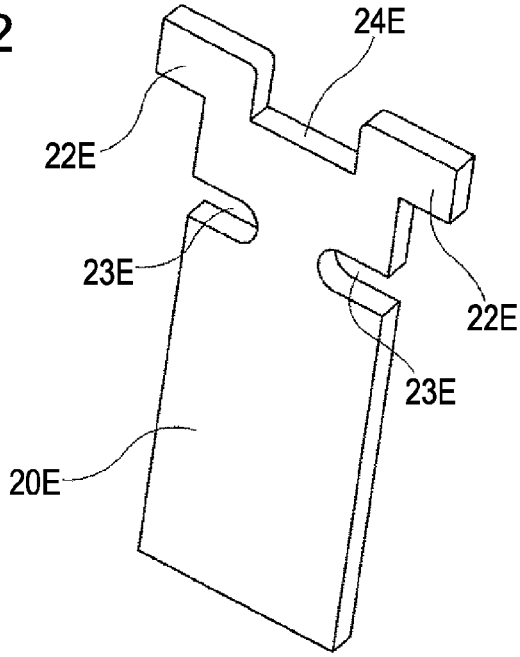
FIG. 12 is a perspective view of a stirrer according to a fourth embodiment of the present invention.
Figure 13:
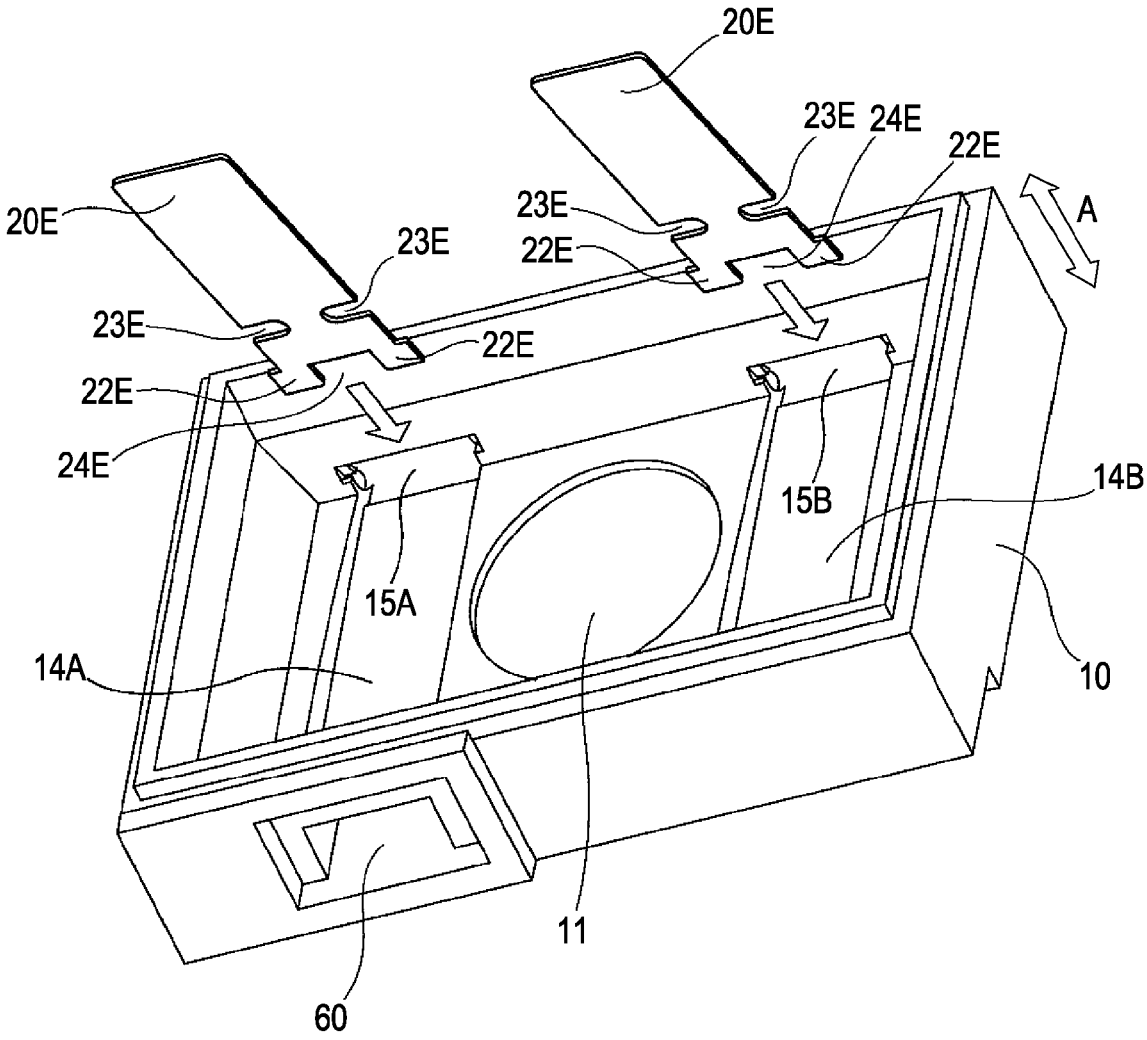
FIG. 13 is a perspective view of the main portion of an ink tank including the stirrer shown in FIG. 12.

FIGS. 12 and 13 are diagrams illustrating a fourth embodiment of the present invention. According to the fourth embodiment, a plurality of notch portions 23E is formed in the periphery of each of two stirrers 20E adjacent to pivot shafts 22E. Additionally, a notch portion 24E is formed between the pivot shafts 22E. Like the through-holes in the above-described embodiments, these notch portions 23E and notch portion 24E form spaces that partially reduce an area of the stirrer 20E facing the inner surface 10A. Accordingly, the notch portions 23E and notch portion 24E function in the same manner as the through-holes of the stirrers described in the above-described embodiments. The notch portions 23E and notch portion 24E generate ink flow in the vicinities of the proximal ends of the stirrers 20E so as to increase the efficiency of agitating the ink. According to the fourth embodiment, since the notch portion 24E is formed at the same height as the pivot shafts 22E, the swing of the stirrer 20E can generate an ink flow towards the top portion of the ink tank. Thus, the efficiency of agitating the ink can be further increased.

According to the present embodiment, the pivot shafts 22E are formed by punching out a plate, which serves as a material of the stirrer 20E. Therefore, unlike the pivot shaft described in the above-described embodiments, the shape of the pivot shaft 22E is not a circular cylinder shape. To increase the inertia force, the stirrer 20E can be formed from a metallic material having a high specific gravity. In this case, by forming the pivot shaft 22E by means of a press work as described in this embodiment, the manufacturing cost of the stirrer 20E can be reduced. However, the whole stirrer 20E may be formed from a metal plate by means of a press work.

To join the stirrer 20E to the tank case 10, as in the above-described case shown in FIG. 3, the pivot shaft 22E of the stirrer 20E is inserted into the supporting portion 15A (15B) in the direction indicated by an arrow in FIG. 13. Thereafter, the pivot shaft 22E rotates. Thus, the stirrer 20E does not come apart from the tank case 10. The stirrer 20E is joined to the tank case 10 without an excessive force exerted on the supporting portion 15A (15B). Thus, the reliability of the supporting portion 15A (15B) can be increased.

Other Embodiments

It is only required that the through-holes and notch portions formed in the vicinity of the proximal end of the stirrer generate an ink flow in the vicinity of the proximal end of the stirrer, namely, an ink flow passing through the vicinity of the pivot shaft of the stirrer. The shape of the stirrer and the number of stirrers can be freely determined. That is, it is only required that these through-holes and notch portions form a space that partially reduces an area of the stirrer facing the inner surface of the tank case and generate an ink flow through that space. In addition, while the above-described embodiments have been described with reference to two stirrers, the number of mounted stirrers may be one or may be equal to or more than three.

Additionally, the present invention can be widely applied to an ink tank used for a variety of recording methods including an inkjet recording method and recording apparatuses.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-255197 filed Sep. 2, 2005, which is hereby incorporated by reference herein in its entirety.

What is claimed is:

1. An ink tank comprising:

the ink supply port facilitating supplying ink contained in an ink tank to outside: and a stirrer configured to agitate the ink;

wherein the stirrer is disposed close to a face of an inner wall of the ink tank, the stirrer including a supported end, rotatably supported by the inner wall, and a free end for performing swinging movement, having the supported end as a center, on a side being opposite to the supported end, wherein the stirrer has a through-hole or a notch portion on a supported end side, and wherein each of the opposite sides of the stirrer and the inner wall are approximately parallel in a condition where the free end is close to the face of the inner wall.

2. The ink tank according to claim 1, wherein the supported end of the stirrer includes a pivot portion and the inner wall of the ink tank includes a hole, and wherein the pivot portion rotatably fits the hole.

3. The ink tank according to claim 1, wherein the stirrer is formed by punching out a metal plate.

4. The ink tank according to claim 1, wherein a plurality of the stirrers are provided in the ink tank.

5. The ink tank according to claim 1, wherein the ink tank contains pigment-based ink including a pigment component.

6. A recording apparatus comprising:

a mounting unit capable of mounting the ink tank according to claim 1 therein, wherein the recording apparatus records an image on a recording medium using ink supplied from the ink supply port of the ink tank mounted in the mounting unit; and a moving unit configured to swing the stirrer with an inertia force caused by reciprocally moving the ink tank mounted in the mounting unit.

7. The recording apparatus according to claim 6, wherein the moving unit includes a reciprocally moveable carriage, and wherein the carriage includes the mounting unit and a recording head capable of ejecting the ink supplied from the ink tank onto the recording medium.

8. The ink tank according to claim 1, wherein in an attitude in which the ink tank is mounted in a recording apparatus, an axis of the supported end is in a horizontal direction.

9. The ink tank according to claim 8, wherein the recording apparatus includes a carriage to be reciprocally moved, and the stirrer swings, receiving inertia force, by the movement of the ink tank being mounted in the carriage.

10. The ink tank according to claim 1, wherein in an attitude in which the ink tank is mounted in a recording apparatus, an axis of the supported end is in a vertical direction.

11. The ink tank according to claim 10, wherein the recording apparatus includes a carriage to be reciprocally moved, and the stirrer swings, receiving inertia force, by the movement of the ink tank being mounted in the carriage.

12. The ink tank according to claim 1, further comprising an elastic member disposed between a flexible member and the inner wall, and the elastic member is a spring member to force the flexible member away from the inner wall.

* * * * *